United States Patent [19]

Johnson

[11] Patent Number: 4,898,403

[45] Date of Patent: Feb. 6, 1990

[54] ROLLER SKI

[76] Inventor: Lennart B. Johnson, Federal Hill Rd., Milford, N.H. 03055

[21] Appl. No.: 302,818

[22] Filed: Jan. 27, 1989

[51] Int. Cl.[4] ..... A63C 17/04

[52] U.S. Cl. ..... 280/842; 188/322.5; 280/11.2; 301/5.7

[58] Field of Search ..... 188/322.5; 280/842, 280/87.042, 11.2, 11.23; 301/5.3, 5.7

[56] References Cited

U.S. PATENT DOCUMENTS

| | | | |
|---|---|---|---|
| 4,497,393 | 2/1985 | Brems | 188/322.5 |
| 4,759,428 | 7/1988 | Seshimo | 188/322.5 X |
| 4,768,793 | 9/1988 | Spencer | 280/842 |
| 4,805,936 | 2/1989 | Krantz | 280/842 |

FOREIGN PATENT DOCUMENTS

| | | | |
|---|---|---|---|
| 1422151 | 1/1976 | United Kingdom | 188/322.5 |

OTHER PUBLICATIONS

PCT/JP88/00552 12/1988.

*Primary Examiner*—Charles A. Marmor
*Assistant Examiner*—Michael Mar
*Attorney, Agent, or Firm*—Fish & Richardson

[57] ABSTRACT

A roller ski that uses a wheel including a stationary member, a rotating tire member, and a liquid between the two to provide viscous damping to rotation of the tire member. The roller ski tire member can increase in width from a hub portion to a crown portion to provide crown edge portions that deflect during edging.

8 Claims, 1 Drawing Sheet

ROLLER SKI

BACKGROUND OF THE INVENTION

The invention relates to roller skis.

Roller skis are very short skis that have front and rear wheels and are used as training devices for skiers when snow is not available. Typically, the rear wheel includes a clutch that prevents rotation in the reverse direction. In the U.S. and Europe, roller skis are typically used on roads, although in Scandinavia and Central Europe a large number of roller ski tracks have been built in the last few years. Physiological studies have shown that roller skiing is the best non-snow training method for maintaining and improving the cardiovascular and neuromuscular functions required for competitive skiing, particularly cross country racing.

In order to promote duplicating the feel and action of regular skis on snow, rolling resistance of roller skis has been increased by using mechanical friction devices and/or wide, soft rubber tires. Mechanical friction devices wear and require adjustment, in addition to adding weight to the ski, and soft tires tend to wear rapidly, requiring frequent replacement.

A tire member 10 of a wheel of a prior art roller ski is shown in FIG. 1. It includes elastomeric tire 12 (typically having a measured Shore Scale A durometer of 50-58) mounted on hub 14. Bearings are received in outer annuler recesses 16, and an axle would typically pass through the bearings. Some prior art tire assemblies 10 include edge portions 18 having an increased radius of curvature in order to increase the area of contact during edging (when the ski and the user's foot are at an oblique angle with respect to the ground) at the expense of reducing the amount of surface of crown 20 in contact with the ground during normal operation.

SUMMARY OF THE INVENTION

In one aspect, the invention features, in general, a roller ski that uses a wheel that includes a stationary member, a rotating tire member that is mounted for rotation with respect to the stationary member, and a liquid between the two members to provide viscous damping to rotation of the tire member. The use of the viscous damping provides sufficient rolling resistance to produce the necessary aerobic training effect and also advantageously reduces speed during downhill rolling, as the friction provided by the liquid increases with speed of rotation.

In preferred embodiments, the stationary member is a spindle, and a stationary member surface and a facing tire member hub surface that contact the liquid are cylindrical in shape; the wheel has sealed bearings closing off the ends of the chamber including the liquid between the spindle and hub; the spindle is sealed to one bearing via a press-fit at mating circumferential surfaces and is sealed to the other bearing via contact of radial surfaces; and the hub is sealed to one bearing by a press-fit and to the other by adhesive. The distance between the hub's inner surface and the spindle's outer surface is between 0.04" and 0.2". The hub is preferably greater than $\frac{3}{4}$" in diameter, and the spindle is preferably about $\frac{1}{2}$" in diameter. The liquid is preferably a silicone having a viscosity between 1,000 and 10,000 centistokes. The tire is preferably made of an elastomeric material having a Shore Scale A durometer of 55 or greater and preferably above 65 to provide good wear resistance.

In another aspect, the invention features in general a roller ski that includes a wheel having a tire made of elastomeric material that increases in width from a hub portion to a crown portion to provide crown edge portions that deflect during edging (i.e., operation when the ski and its tires are at an angle to the ground). By employing wider crown edge portions that deflect during edging, a large crown width still contacts the ground surface during normal operation, and a substantial width also contacts the ground during edging, owing to the deflection, for greater control. The deflecting crown edge portions improve turning and make it easier to snow plow and come to a stop. It also reduces tire wear.

In preferred embodiments, the tire has a curved surface where the width increases from the hub portion to the crown edge portion; the crown edge portion has a radial thickness of between 1/16" and $\frac{1}{4}$" (most preferably about $\frac{1}{8}$") at the side wall face; the radius of curvature at the curved surface between the hub portion and crown portion is between $\frac{1}{8}$" and $\frac{3}{8}$" (most preferably about $\frac{1}{4}$"). The elastomeric material preferably has a Shore Scale A durometer of greater than 55 and most preferably greater than 65.

Other advantages and features of the invention will be apparent from the following description of a preferred embodiment thereof and from the claims.

DESCRIPTION OF THE PREFERRED EMBODIMENT

The preferred embodiment will now be described.

DRAWINGS

STRUCTURE

Figure 1:
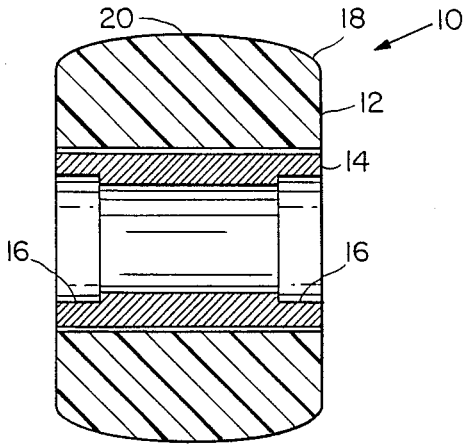
Fig. 1 PRIOR ART
FIG. 1 is a vertical sectional view showing a wheel of a prior art roller ski.
Figure 2:
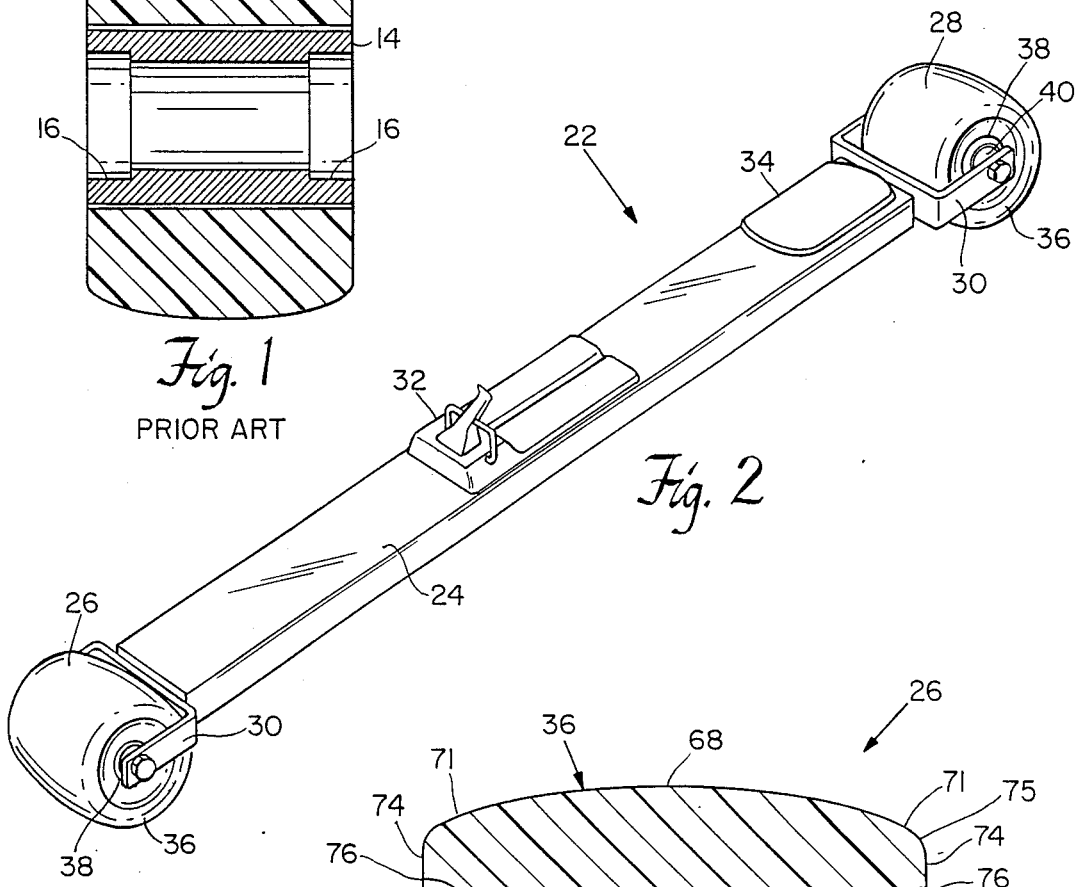
FIG. 2 is a diagrammatic perspective view showing a roller ski according to the invention.

Referring to FIG. 2, there is shown roller ski 22 including elongated aluminum base member 24 and front wheel 26 and rear wheel 28 rotatably mounted on aluminum forks 30 on base member 24. Elongated base member 24 also includes binding 32 and elastomeric heel pad 34 for receiving a ski boot. Both wheels 26, 28 include identical tires 36 and hubs 38. Rear wheel 28 includes a one-way clutch 40 inside of hub 38. Front wheel 26 does not include a clutch, but does include liquid damping according to the invention as shown in FIG. 3.

Figure 3:
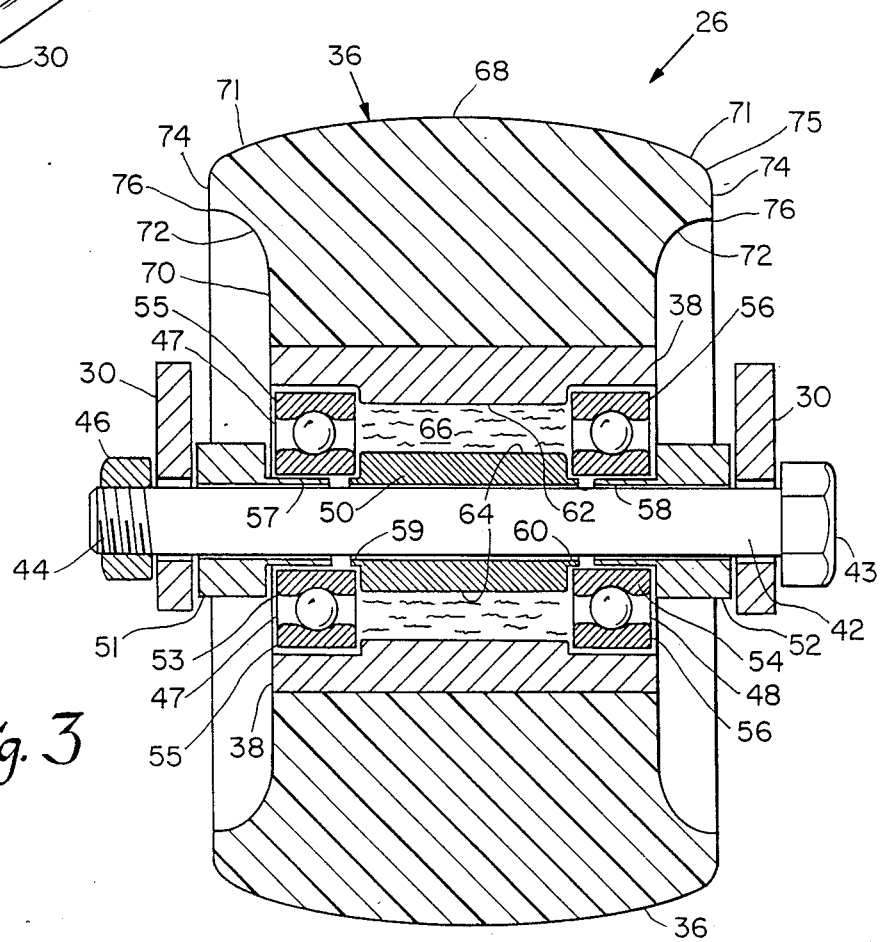
FIG. 3 is a diagrammatic vertical sectional view of a wheel of the FIG. 2 roller ski employing liquid damping and a large width crown portion according to the invention.

Referring to FIG. 3, wheel 26 is mounted on fork 30 via bolt 42 having a head 43 at one end and a threaded end 44 at the other for mating with nut 46. Hub 38 is rotatably mounted with respect to bolt 42 via sealed bearings 47, 48 mounted between the end inner surfaces of hub 38 and the facing surfaces of spindle 50 and spacers 51, 52 on bolt 42. Bearings 47, 48 include inner rings 53, 54 and outer rings 55, 56. Spacers 51, 52 include narrowed extensions 57, 58 that extend partially under inner rings 53, 54. Spindle 50 includes extensions 59, 60 that also extend partially under inner rings 53, 54. A chamber containing viscous damping liquid 66 is defined by inwardly directed hub surface 62 of hub 38, facing outwardly directed surface 64 of spindle 50, and the inner side walls of bearings 47, 48.

Viscous damping liquid 66 is a conventional silicone (polydimethylsiloxane trimethylsioloxy terminated) having viscosities ranging from 1,000 to 10,000 centistokes. Liquid 66 maintains substantially constant viscosity over the expected temperature range.

Tire 36 is made of a neoprene rubber similar to the rubber used in existing roller ski wheels, though the measured Shore Scale A durometer is approximately 67. Preferably, the durometer is greater than 55 (most preferably greater than 65) in order to provide improved wear resistance. Other elastomeric materials, e.g., natural rubber, or urethane, can be used.

Tire 36 includes crown portion 68, which has a greater width than hub portion 70. This provides crown edge portions 71 that deflect during edging. Curved surface 72 increases in width from hub portion 70 to the junction with side wall 74 and has a 0.25" radius of curvature. The width of tire 36 between side walls 74 is 1.8". The diameter of tire 36 at its largest diameter of crown portion 68 is 2.6". The crown surface at crown portion 68 has a 3.4" radius of curvature. Curved edge portion 75 at the junction between side wall 74 and the 3.4" radius of curvature of the crown surface of crown portion 68 has a radius of curvature of 0.125". The diameter at junction 76 between side wall 74 and curved portion 72 is 1.6". The thickness of crown edge portion 71 thus varies from about ⅛" to about ½", having around a ¼" thickness over a substantial part. The diameter of hub surface 62 is 0.786" and is the same in both front wheel 26 and rear wheel 28 so that the same tire members can be used in the front and rear wheels 26, 28. This diameter is chosen to accommodate one-way clutch 40. The diameter of spindle surface 64 is 0.500". This provides a gap between the two of about 0.143". The diameter of spindle surface 64 could be increased in order to increase the liquid damping effect; however, doing so would increase the weight of the wheels (the aluminum spindle has a specific gravity of 2.86 as compared with a specific gravity 0.97 for liquid 66), and the reduction in volume of liquid 66 would increase the chance of possible detrimental effect if there is a loss of liquid 66. The fluid damping effect can also be affected by using different viscosity liquid 66.

In manufacture, spacer 52, bearing 48, spindle 50 and tire 36 (with its molded-in-place hub 38) are mounted on an assembling shaft similar in size to bolt 42. The outer circumferential surface of outer ring 56 is glued to the facing inner, circumferential surface of spindle 38. The overlapping circumferential surfaces of inner ring 54 and extension 60 of spindle 50 are press-fit together, thereby providing a seal between the inner surface of hub 38 and the outer surface of spindle 50 at the right-hand side. A measured amount of liquid 66, which is highly viscous, is injected into the space between opposing cylindrical surfaces 62, 64. Bearing 47 and spacer 51 are then added. The outer circumferential surface of the outer ring 55 of bearing 47 makes a press-fit with the facing circumferential surface of hub 38. The inner radial surface of bearing 47 contacts the facing radial surface of spindle 38 upon the application of pressure along the longitudinal axis by spacer 51, spindle 38 being slightly longer between its radial faces than the corresponding dimension on hub 38. Tire 36 and its bearings, spindle and spacers are then mounted on bolt 42 and fork 30 of elongated base member 24 of roller ski 22. When nut 46 is tightened, the contact of the inner radial surface of bearing 47 with the facing radial surface of spindle 38 is maintained.

Operation

In operation, a user's boot is attached to binding 32, and the user alternately pushes and rolls, simulating cross-country skiing. One-way clutch 40 in rear wheel 28 prevents rearward movement of roller ski 22. In front wheel 26, spindle 50, inner bearing rings 53, 54, spacers 51, 52 and bolt 42 are prevented from rotation, and tire 36, hub 38, and outer bearing rings 55, 56 rotate about the stationary components. High viscosity liquid 66 between facing cylindrical surfaces 62, 64 acts as a damping device and increases the force required to rotate tire 36 about the stationary components. The resistance provided by the liquid increases greatly at higher speeds, acting to reduce the terminal velocity (maximum speed on a given incline), making the skis easier to use and much safer. The energy removed by damping results in heat, but the heat is rapidly removed from the wheel assembly through aluminum fork 30 and aluminum base member 24. Air flow removes the heat from the large surface of base member 24, and heat build-up in the wheel is not a problem. The extent of fluid damping can be changed by changing the space between the rotating and the stationary members and/or by changing the viscosity of the liquid. Changing damping solely by changing viscosity is advantageous as it does not require making different size parts and does not result in an increase in weight when increasing damping. Another advantage of liquid damping is permitting rolling resistance to be maintained while using more durable, harder tire material. Also, using viscous liquid damping does not result in wear, like with mechanical devices, and adds very little weight to the wheel.

Because solid rubber does not readily compress but generally displaces, edging or tilting of skis during ski motion tends to cause excessive wear on the edges of a tire. This is more pronounced on rear wheels, which carry about 60-70% of the weight. By making hub portion 70 of tire 36 smaller in width than crown portion 68 and employing curved surface 72 at the transition between the two, the rubber at crown edge portion 71 is more easily displaced during edging, resulting in an increase in area of contact during edging while maintaining the same area of contact at crown portion 68 during normal operation. This results in smoother turning motion and it also reduces the wheel weight, as substantially less material is required in hub portion 70. This reduction in tire material and weight is not at the expense of the width of crown portion 68, which is still sufficiently wide to be stable and to absorb shock.

Roller skis 22 have sufficient rolling resistance to produce the necessary aerobic training effect, are light, duplicate the feel of snow skis, provide a safe terminal velocity on inclines, and are sufficiently stable to allow for controlled turns and permit snowplowing.

Other Embodiments

Other embodiments of the invention are within the scope of the following claims. For example, other elastomeric materials and other dimensions could be used. Also, the components defining the chamber for the damping liquid could have different shapes than cylindrical components with facing cylindrical surfaces, though the use of cylindrical surfaces advantageously permits large surface area and small distance between the two surfaces.

What is claimed is:

1. A roller ski comprising:

an elongated base member and two wheels rotatably mounted at opposite ends of said base member by respective axles, one said wheel including a stationary member that is stationary with respect to said base member and a tire member that is mounted for rotation with respect to said stationary member, said tire member including a hub and an elastomeric tire mounted on said hub, said stationary member and said tire member having a respective stationary surface and a respective rotating surface that each partially define a chamber, said wheel including a liquid in said chamber to provide viscous damping to rotation of said tire member, said liquid being sufficiently viscous to provide resistance for retarding rotation of the wheel, the resistance increasing as a function of the rotational speed of the wheel, thereby acting to reduce the terminal velocity of the roller ski, wherein said stationary member includes an elongated spindle and said hub includes said rotating surface, said spindle having an outer substantially cylindrical surface forming said stationary surface and said hub having an inner substantially cylindrical surface forming said rotating surface, said outer cylindrical surface and said inner cylindrical surface facing each other and having a predetermined spacing therebetween.

2. The roller ski of claim 1 wherein said one wheel includes sealed bearings provided between said stationary surface and said rotating surface to provide said rotation and provide a seal between said rotating surface and said stationary surface.

3. The roller ski of claim 2 wherein a said bearing has a circumferential surface in press-fit engagement with a facing circumferential surface of said spindle.

4. The roller ski of claim 1 wherein the spacing between said surfaces is greater than 0.04" and less than 0.2".

5. The roller ski of claim 1 wherein said tire member is made of elastomeric material having a Shore Scale A durometer greater than 55.

6. The roller ski of claim 5 wherein said elastomeric material has a Shore Scale A durometer greater than 65.

7. The roller ski of claim 1 wherein said liquid is silicone.

8. The roller ski of claim 1 wherein said liquid has a viscosity between 1,000 and 10,000 centistokes.

* * * * *